US005115784A

United States Patent [19]

Mito et al.

[11] Patent Number: 5,115,784

[45] Date of Patent: May 26, 1992

[54] FUEL INJECTION SYSTEM

[75] Inventors: Mitsumasa Mito; Keisuke Daikoku, both of Hamamatsu, Japan

[73] Assignee: Suzuki Jidosha Kogyo Kabushiki Kaisha, Japan

[21] Appl. No.: 541,720

[22] Filed: Jun. 21, 1990

[30] Foreign Application Priority Data

Jun. 21, 1989 [JP] Japan ..... 1-56672
Jul. 31, 1989 [JP] Japan ..... 1-199023

[51] Int. Cl.[5] ..... F02M 34/00

[52] U.S. Cl. ..... 123/516; 123/514

[58] Field of Search ..... 123/510, 511, 514, 516, 123/518

[56] References Cited

U.S. PATENT DOCUMENTS

| | | | |
|---|---|---|---|
| 1,909,390 | 5/1933 | Ball et al. | 123/516 |
| 2,293,884 | 8/1942 | Boyce | 123/510 |
| 2,599,699 | 7/1952 | Dilworth et al. | 123/514 |
| 2,706,976 | 4/1955 | Gianini | 123/514 |
| 4,129,106 | 12/1978 | Sellman | 123/516 |
| 4,385,615 | 5/1983 | Keane | 123/516 |
| 4,502,450 | 3/1985 | Duprez | 123/516 |
| 4,508,076 | 4/1985 | Oda et al. | 123/339 |
| 4,543,938 | 10/1985 | Szlaga | 123/514 |
| 4,722,708 | 2/1988 | Baltz | 123/518 |
| 4,763,633 | 8/1988 | Nakanishi | 123/514 |
| 4,794,889 | 1/1989 | Hensel | 123/514 |
| 4,809,666 | 3/1989 | Baltz | 123/516 |
| 4,844,043 | 7/1989 | Keller | 123/516 |
| 4,876,993 | 10/1989 | Slattery | 123/516 |

FOREIGN PATENT DOCUMENTS

| | | | |
|---|---|---|---|
| 0164652 | 8/1985 | Japan | 123/516 |

*Primary Examiner*—E. Rollins Cross
*Assistant Examiner*—Thomas N. Moulis
*Attorney, Agent, or Firm*—Bruce L. Adams; Van C. Wilks

[57] ABSTRACT

A fuel injection system of an outboard motor is provided with a vapor separator as a fuel tank disposed in the outboard motor and the system includes a fuel return pipe connected to the vapor separator, a fuel supply pipe connected to the vapor separator for supplying fuel to the fuel injector and a vent means connected to the vapor separator. The vent means is connected to a port formed to the throttle body through a connection hose on an upstream side of the throttle valve. The port formed to the throttle body is opened at a portion at which an air flows in the throttle body with highest flowing speed and upstream and downstream sides of the throttle valve are communicated through a by-pass passage which is provided with a port on the upstream side of the throttle valve opened near the port formed to the throttle body. In another aspect of the vapor separator, the fuel return pipe has one end opened to an interior of the vapor separator at a portion below a surface level of fuel stored in the vapor separator and the vapor separator is provided with a bottom portion outwardly projecting. The fuel supply pipe has one end opened to the interior of the vapor separator at a projected top end of the bottom portion.

17 Claims, 9 Drawing Sheets

FUEL INJECTION SYSTEM

BACKGROUND OF THE INVENTION

The present invention relates to a fuel injection system particularly of an outboard motor of an electrically controlled fuel injection type.

An outboard motor is generally equipped with a two-cycle engine in which fuel is supplied in accordance with an electrically controlled fuel injection (EFI) system.

In the EFI system, a fuel injector is located in an air intake passage connected to a crank chamber of an engine and the air supply quantity is controlled by a throttle valve and fuel injection quantity is controlled by an electrical control apparatus which calculates the most suitable air supply quantity in response to load in the crank chamber and the air intake passage. The fuel pumped up by a high pressure pump from a fuel tank is always supplied to the fuel injector and the fuel not consumed in the fuel injector is returned to the fuel tank.

In the outboard motor of the type described above and including the fuel tank equipped on the side of a hull body, it is necessary to arrange a long pipe or conduit. In order to obviates this inconvenience, a vapor separator as a sub-tank is equipped in the outboard motor body and the fuel supply to the fuel injector and the fuel return are performed mainly by means of the vapor separator. In the vapor separator, a float valve is disposed to thereby maintain a constant quantity of the fuel under the fuel supply from a main fuel tank disposed in the hull body.

However, in the vapor separator disposed in the outboard motor body, vapors generated therein are floated near the engine unit including electrical elements or parts, so that some countermeasure against explosion due to the vapors will be needed.

In order to prevent such adverse phenomenon, U.S. Pat. No. 4794889 discloses a technology in which an air vent for bleeding the vapor in the vapor separator is connected to the downstream side of a throttle valve in an air intake passage to thereby bleed the vapor into a crank case.

Even in this technology, however, there is a fear of sucking the fuel in addition to the vapor into the crank case in a case when the absolute boost pressure in the air intake passage is high (for example, when the degree of opening of the throttle valve is small at the high rotation speed due to rapid deceleration), resulting in engine trouble.

Moreover, in the system described above, in which the load in the air intake passage is detected for the purpose of calculating the fuel injection quantity, the load is unevenly detected because of the inclusion of the vapor and the degree of the inclusion is not measured specifically, so that the fuel quantity is erroneously measured, thus degrading the performance of the engine.

Furthermore, the vapor separator usually comprises a tank body having a flat bottom to which a fuel supply pipe is connected and an upper portion to which a fuel return pipe is connected. In this arrangement, however, a connecting port for the return pipe is formed on the upper portion of the vapor separator. Accordingly, the return fuel passing the return pipe is directly dropped on the fuel stored in the tank body from the upper portion of the fuel in liquid state. Thus, air bubbles may be continuously caused in the fuel stored in the tank body bY the impact of the dropped fuel through the connecting port for the return pipe. These air bubbles may be liable to be sucked into a fuel supply pipe together with the fuel. In such an adverse case, the fuel including the air bubbles may be fed into the fuel injector, thus not ensuring suitable fuel injection.

In another adverse case, in which the port connected to the fuel supply pipe may be exposed to the atmosphere when the liquid surface of the fuel in the tank body of the vapor separator is largely inclined due to the centrifugal force at a time when the hull is rapidly and largely turned, atmospheric air may also be introduced into the fuel supply pipe. In such a case, the fuel including the air may be fed into the fuel injector, thus also not ensuring suitable fuel injection.

SUMMARY OF THE INVENTION

An object of the present invention is to substantially eliminate the defects or drawbacks encountered to the prior art described above and to provide a fuel injection system particularly of an outboard motor capable of surely supplying fuel including substantially no air to a fuel injector.

Another object of the present invention is to provide a fuel injection system of an outboard motor including a vapor separator having an improved structure capable of feeding the fuel including substantially no air to the fuel injector.

These and other objects of the present invention can be achieved in one aspect according to the present invention by providing a fuel injection system of an outboard motor in which a first fuel tank is disposed on an inboard (hull) side and a second fuel tank connected to the first fuel tank is disposed on an outboard motor side, the second fuel tank being constituted as a vapor separator, the system including an engine including an air intake passage means comprising a throttle body in which a throttle valve is disposed and an intake manifold to which a fuel injector is mounted, the system further comprising a fuel make-up pipe connected to the vapor separator for supplying a make-up fuel, a fuel return pipe connected to the vapor separator, a fuel supply pipe connected to the vapor separator for supplying fuel to the fuel injector, and a vent means connected to the vapor separator, the vent means being connected to a port formed to the throttle body through a hose means on an upstream side of the throttle valve.

The port formed to the throttle valve body is opened at a portion at which air flows in the throttle body with highest flowing speed and an upstream side and a downstream side of the throttle valve are communicated with each other through a by-pass passage, the by-pass passage being provided with a port on the upstream side of the throttle valve opened near the port formed to the throttle body.

According to the structure of this aspect of the present invention, the vapor generated in the vapor separator is sucked together with air into the air intake passage and is not discharged outward, thus preventing danger of the explosion of electrical equipments arranged in the system by the fuel in the engine chamber. Moreover, the pressure in the throttle body is not made negative when the throttle valve is rapidly closed and, hence, the pressure variation is made small, so that the fuel in the vapor separator is hardly sucked and the fuel surface level maintains stably, thus not forming foams or bubbles, whereby the vapor in the fuel is substantially not fed to the fuel injector. In addition, on the downstream side of the throttle valve is not formed a direct opening and, accordingly, the negative pressure characteristic is only related to the opening degree of the throttle valve, so that the EFI system can measure the fuel quantity with high precision, thus improving the engine performance.

In another aspect of the present invention, there is provided a fuel injection system of an outboard motor in which a first fuel tank is disposed on an inboard (hull) side and a second fuel tank connected to the first fuel tank is disposed on an outboard motor side the second fuel tank being constituted as a vapor separator, the system including a fuel make-up pipe connected to the vapor separator for supplying a make-up fuel, a fuel return pipe connected to the vapor separator, a fuel supply pipe connected to the vapor separator for supplying fuel to the fuel injector, and a vent means connected to the vapor separator, the fuel return pipe having one end opened to an interior of the vapor separator at a portion below a surface level of fuel stored in the vapor separator.

The vapor separator is provided with a bottom portion outwardly projecting and the fuel supply pipe has one end opened to the interior of the vapor separator at a projected top portion of the bottom portion of the vapor separator.

According to this aspect of the present invention, the connection port of the fuel return pipe is formed at a portion near the bottom of the vapor separator below the surface level of the fuel stored therein, so that the fuel is returned to the vapor separator without dropping on the surface of the fuel stored in the vapor separator, thus not forming bubbles in the fuel and supplying fuel including substantially no air to the fuel injector. In addition, the fuel supply pipe is located on the projected top end of the bottom portion of the vapor separator, so that the air is not fed to the fuel injector through the fuel supply pipe in a case where the vapor separator is inclined for example even in a case where the centrifugal force is applied to the fuel in the vapor separator.

DESCRIPTION OF THE PREFERRED EMBODIMENTS

In advance of the description of the preferred embodiments of the present invention, the conventional technology of the art of field to which present invention belongs will be first described hereunder with reference to an example of the accompanying drawings.

Figure 8:
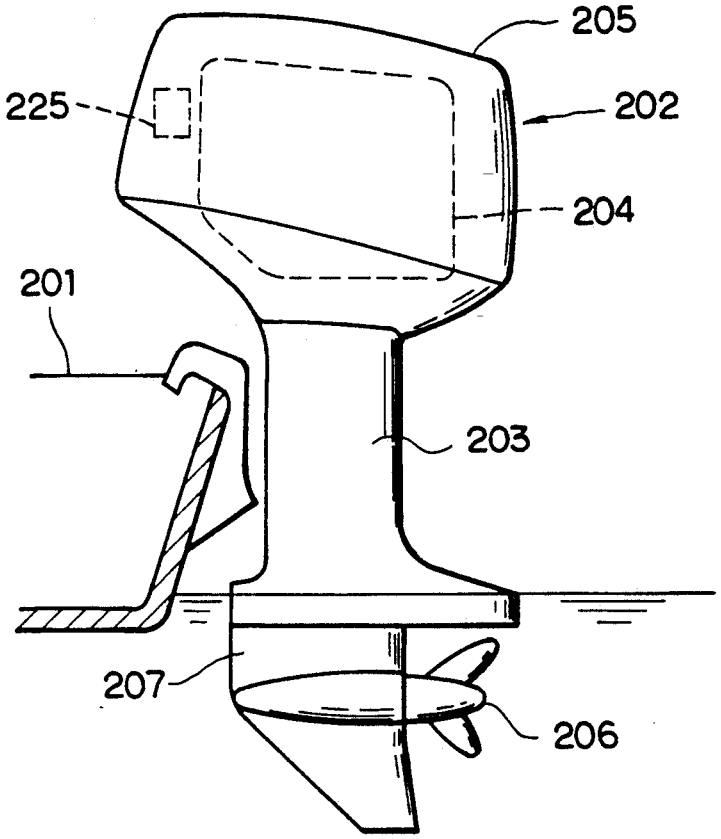
FIG. 8 PRIOR ART
FIG. 8 is a brief side view of an outboard motor equipped with a conventional fuel supply and injection system.

Referring to FIG. 8 showing an outboard motor secured to a body of a hull, an outboard motor 202 is secured to an outside of a rear portion of a hull 201 to propel the same. The outboard motor 202 comprises a drive shaft housing 203, an engine unit 204 disposed above the drive shaft housing 203 and covered by a engine cover 205, and a gear case 207 secured to the lower portion of the drive shaft housing 203. A propeller 206 which is driven by the operation of the engine unit 204 is mounted to the gear case 207.

In FIG. 8, reference numeral 225 designates a vapor separator, which will be described in detail hereinafter.

Figure 9:
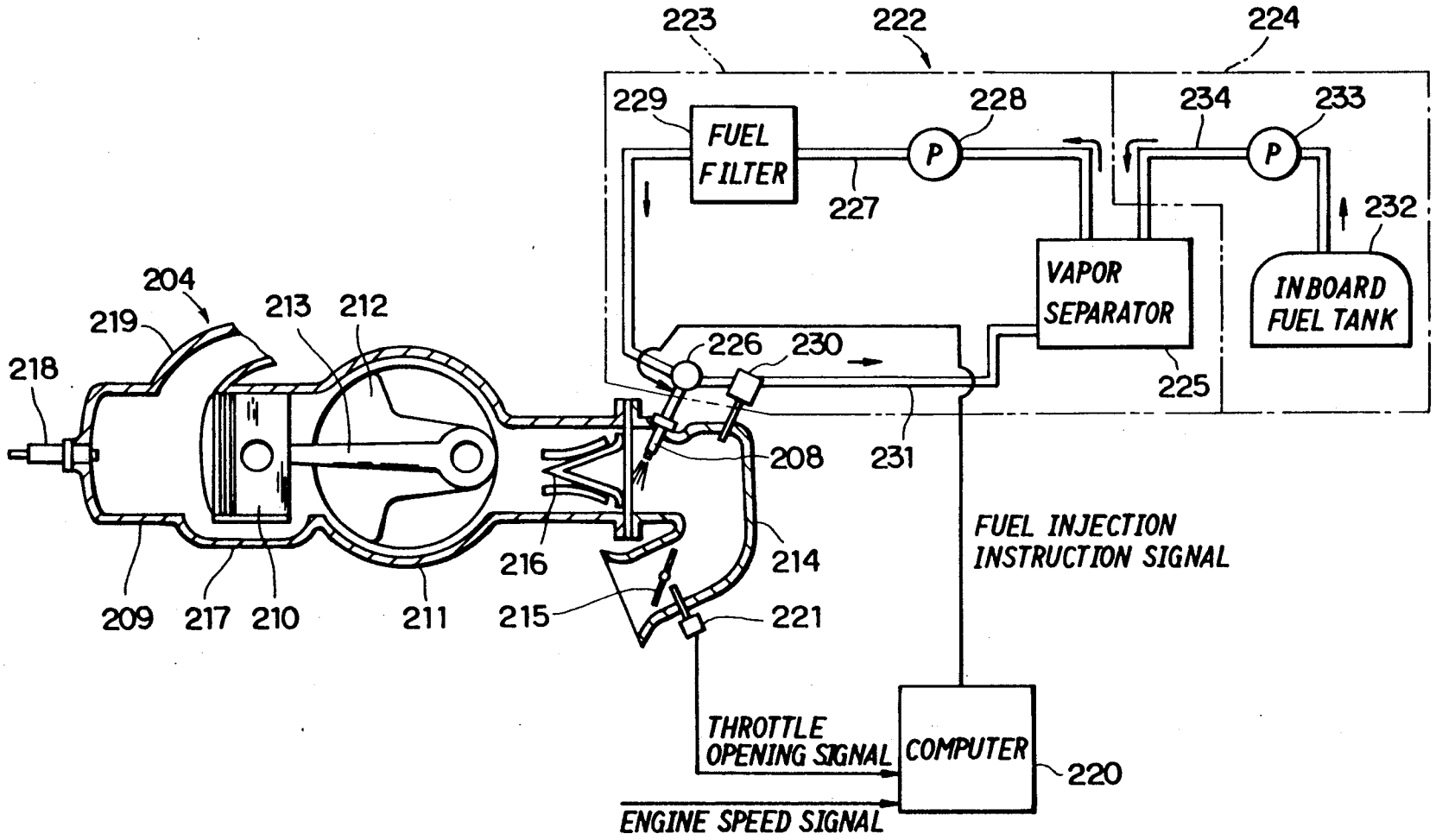
FIG. 9 PRIOR ART
FIG. 9 is a schematic view showing a structure arrangement of the system of the outboard motor shown in FIG. 8.

FIG. 9 is a diagramatic schematic view of a two-cycle engine as a typical example of the engine unit 204, in which fuel is supplied by a fuel injector 208. The two-cycle engine 204 includes a cylinder assembly 209 in which a piston 210 is accommodated and the piston 210 is connected through a control rod 213 to a crank shaft 212 disposed in a crank case 211. An intake pipe 214 is connected to the crank case 211 and the intake pipe 214 is equipped with a throttle valve 215, a fuel injector 218 and a reed valve 216.

The throttle valve 215 serves to control the air intake quantity and the fuel is fed from the fuel injector 208 into the intake air to create an air-fuel mixture, which is then introduced into the crank case 211 through the reed valve 216. The air-fuel mixture introduced into the crank case 211 is then fed into the cylinder 209 through a scavenge passage 217 and burned by means of an ignition plug 218 to drive the piston 210. Exhaust gas after the burning is exhausted externally through an exhaust passage 219.

The fuel injection from the fuel injector 208 is controlled by computer means 220, which transmits a signal for instructing the fuel injection to the fuel injector 208 in response to signals representing the engine speed from the engine 204 and representing the throttle opening degree from a sensor 221 for detecting the throttle opening degree.

A fuel supplying system 222 for supplying the fuel to the fuel injector 208 comprises a fuel circulation unit 223 and a fuel make-up unit 224. The fuel circulation unit 223 includes a sub-tank 225 as the second fuel tank for the circulation fuel, called hereinafter a vapor separator. The vapor separator 225 is operatively connected through a fuel supply pipe 227 to a delivery pipe 226 connected to the fuel injector 208. A fuel pump 228 and a fuel filter 229 are incorporated to the fuel supply pipe 227. To the delivery pipe 226 is connected to a return pipe 231 to which a pressure regulator 230 is mounted and which is connected to the vapor separator 225.

Accordingly, the fuel in the vapor separator 225 is fed to the fuel injector 208 through the fuel supply pipe 227 and the excessively supplied fuel is returned to the vapor separator 225 by the operation of the pressure regulator 230 through the return pipe 231. The circulation unit 223 including the vapor separator 225 with the described associated elements and the computer 220 are incorporated in the engine case 205 shown in FIG. 8 in addition to the engine unit 204.

In the fuel make-up unit 224 of FIG. 9, an inboard fuel tank as the first fuel tank 232 is incorporated so as to be mounted to the body of the hull 201. The inboard fuel tank 232 and the vapor separator 225 are mutually connected through a fuel make-up pipe 234 in which a mechanical pump 233 is incorporated. The mechanical pump 233 is operated by the operation of the negative pressure in the crank case 211 to supply the fuel of necessary quantity into the vapor separator 225 to compensate for the fuel consumed by the engine 204.

Figure 10:
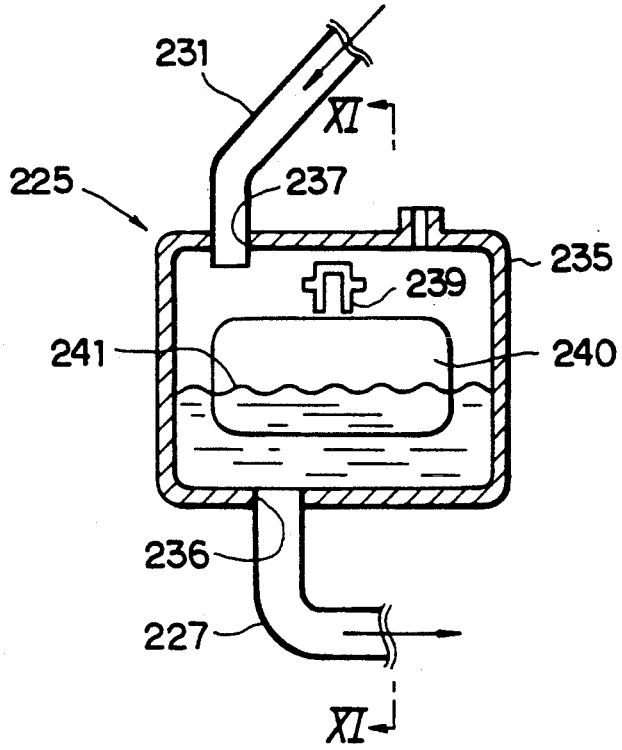
FIG. 10 PRIOR ART
FIG. 10 is a sectional view of the vapor separator shown in FIG. 9.
Figure 11:
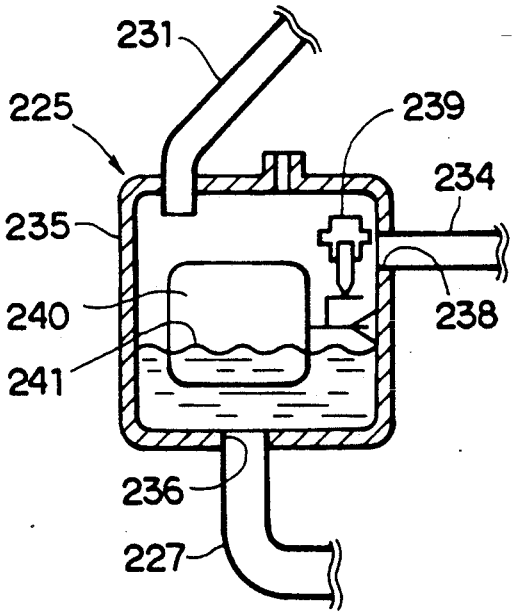
FIG. 11 PRIOR ART
FIG. 11 is a sectional view taken along the line XI—XI shown in FIG. 10.

The detail of one example of a conventional vapor separator 225 is shown in FIG. 10 or 11, in which the vapor separator comprises a tank body 235 having a flat bottom to which a port 236 for connecting the tank body 235 to the fuel supply pipe 227 and an upper portion to which a port 237 for connecting the tank body 235 to the return port 231. A port 238 for connecting the tank body 235 to the fuel make-up pipe 234 is also formed to the side portion of the tank body 235 near the upper portion thereof.

A needle valve 239 is arranged in the tank body 235 in association with the connection port 238. The needle valve 239 is subjected to open-close control by the vertical movement of a float 240 disposed in the tank body 235 in a floating manner in the liquid state fuel so that the fuel is made up into the tank body 235 from the inboard tank 232 through the make-up port 238 by the opening or closing of the needle valve 239 in response to the vertical movement of the float 240 due to the change of the liquid surface level of the fuel 241 in the tank body 235.

However, the fuel supply and injection system of the conventional type of the character described above provides the problems described hereinbefore.

The present invention conceived by taking the conventional technology into consideration will be described hereunder with reference to the accompanying drawings.

Figure 1:
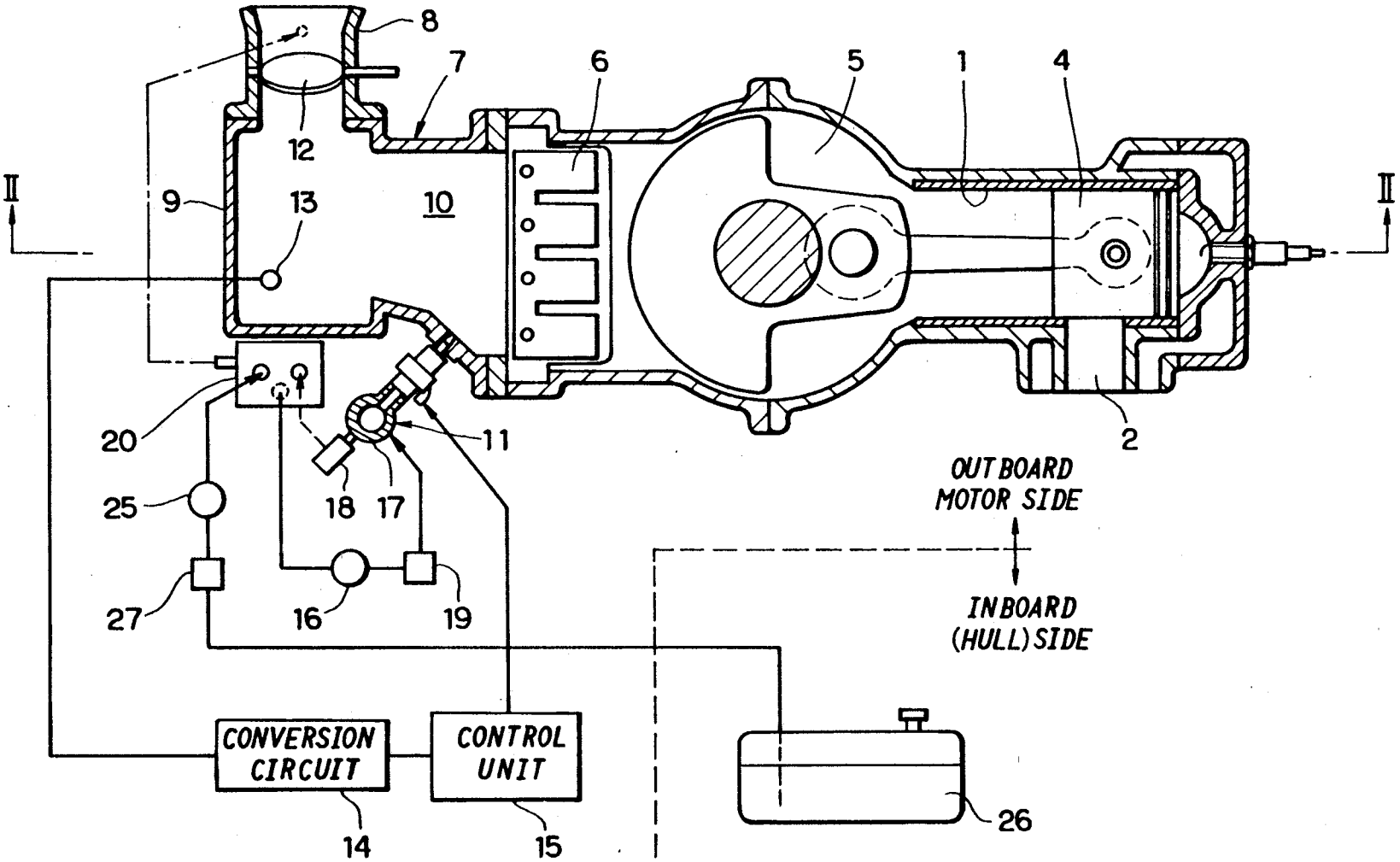
FIG. 1 is a sectional plan view of an engine of an outboard motor including a fuel injection system according to the present invention.

FIG. 1 is a longitudinal section of a two-cycle engine unit of an outboard motor in relation to the present invention and the engine is provided with a cylinder assembly 1 to which an exhaust passage 2 and a scavenge passage 3 (FIG. 2) are opened. These passages are opened or closed by the sliding movement of a piston 4 accommodated in the cylinder assembly 1. An air intake passage 7 is communicated with a crank case 5 through a reed valve 6.

The air intake passage 7 is composed of a throttle body 8, a surge tank 9 and an intake manifold 10. An electromagnetically operating fuel injector 11 is mounted to the intake manifold 10. The fuel injected and the air intake are mixed and the air-fuel mixture is then fed into each of the crank cases 5. The air quantitY to be supplied is controlled by a throttle valve 12 incorporated in a throttle body 8 and the fuel quantity to be injected is controlled by an electrically controlled fuel injection (EFI) system to a quantity suitably in proportion to the air supply quantity.

In the EFI system, an inner pressure in the surge tank 9 is detected by a pressure sensor 13 and the detected value is transferred to a conversion circuit 14. The most suitable fuel supply quantity is calculated by an electrica control unit 15 in accordance with the detected value and a signal representing the calculated result is transmitted to control the fuel injection quantity of the fuel injector 11.

To the fuel injector 11 is supplied the fuel fed by a high pressure pump 16 through a delivery pipe 17 to which a pressure regulator 18 is mounted to release a part of the fuel at a time when the the pressure applied to the fuel is beyond the predetermined value to thereby maintain the fuel pressure at a constant value. In FIG. 1, reference numerals 19 and 27 designate high and low pressure filters, respectively.

The fuel supply and the fuel return circulation to the fuel injector 11 are performed mainly by way of a vapor separator 20.

Figure 2:
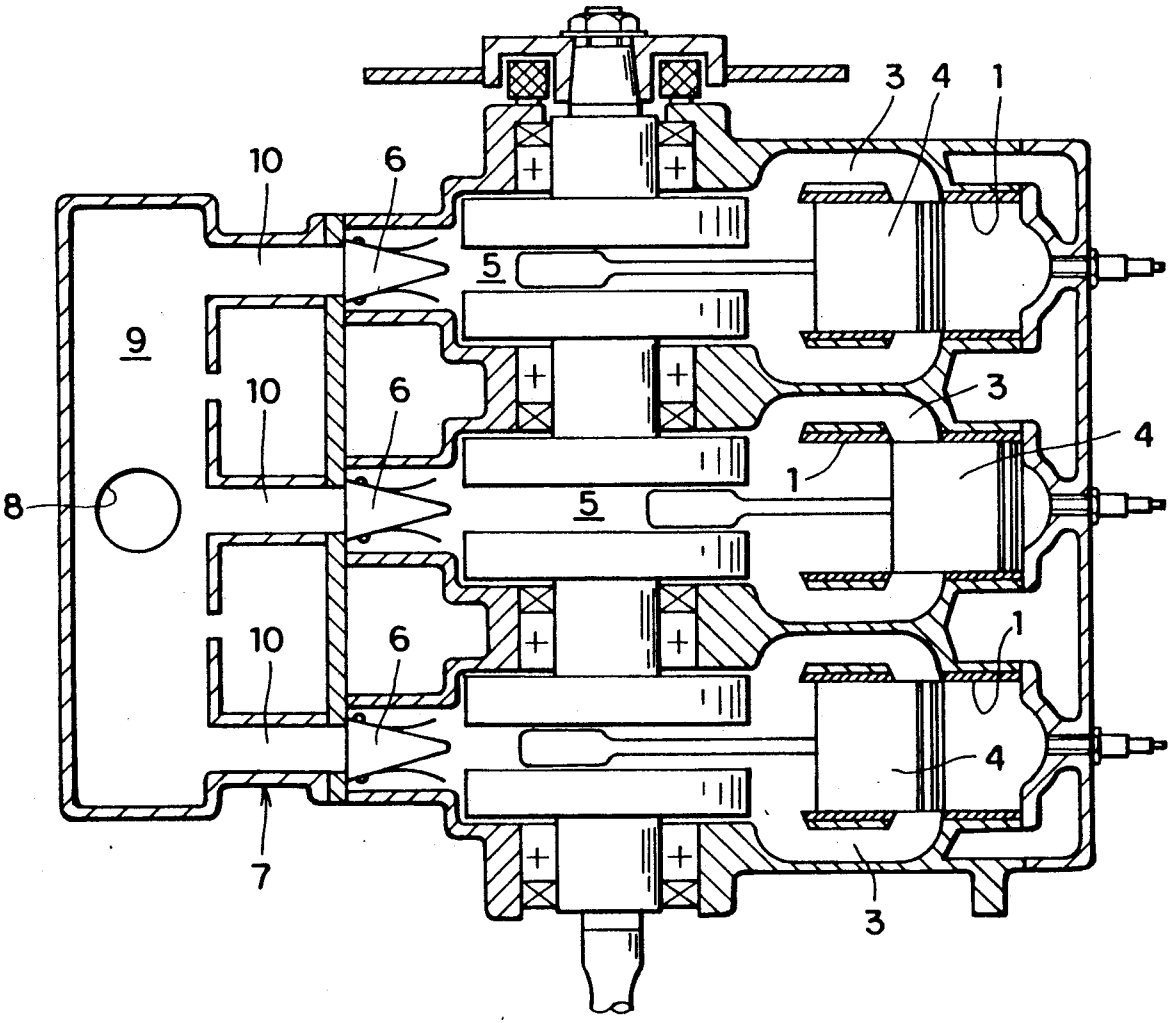
FIG. 2 is a sectional view taken along the line II—II shown in FIG. 1.

FIG. 2 is a sectional view taken along the line II—II shown in FIG. 1 for showing a three-cylinder two cycle engine, for example.

Figure 3:
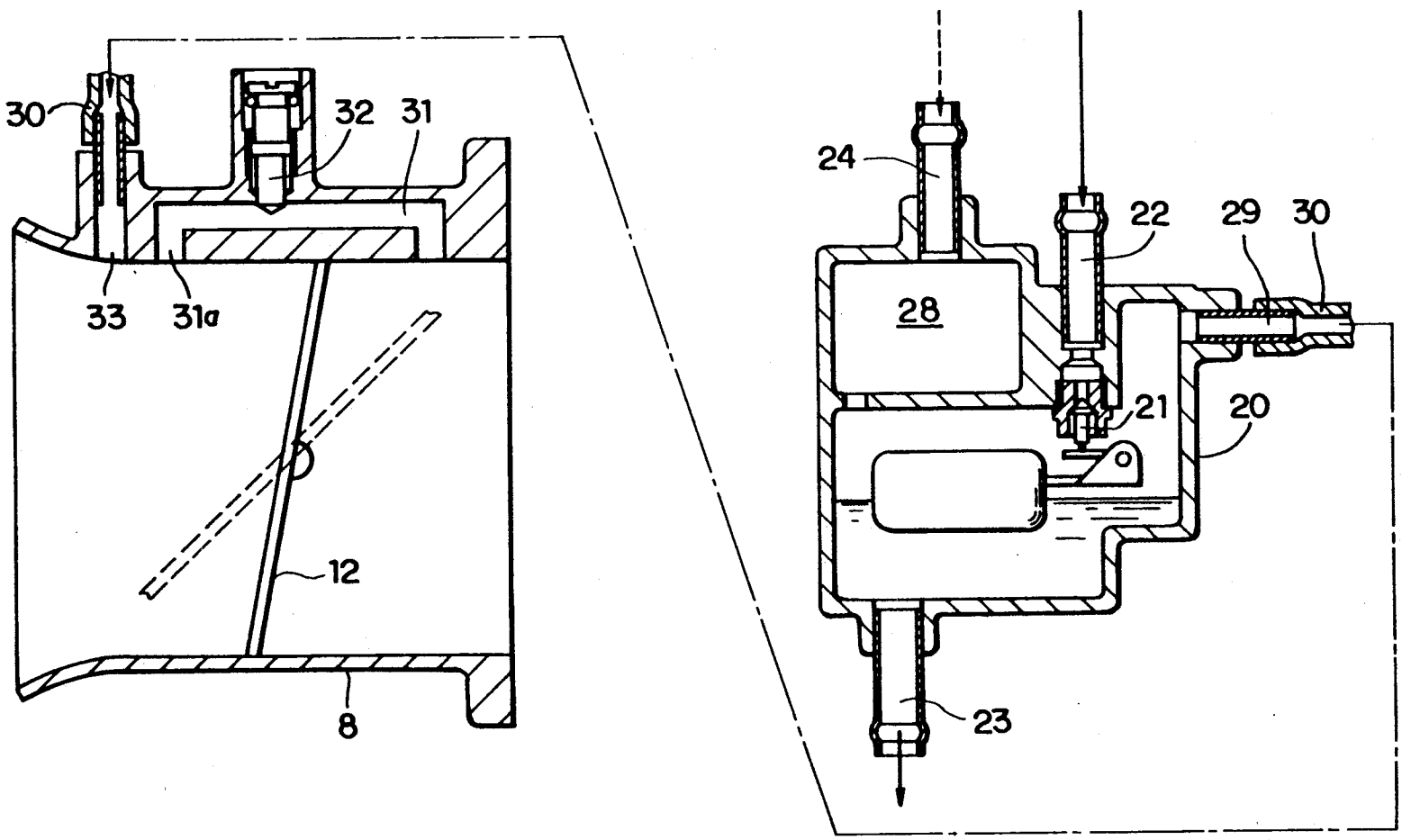
FIG. 3 is an enlarged sectional view showing a connection relationship between a vapor separator and a throttle body of the system shown in FIG. 1.

The detail of the vapor separator 20 is shown in FIG. 3, in which a fuel make-up pipe means 22, a fuel supply pipe means 23 and a return fuel circulation pipe means 24 have openings opened to the interior of the vapor separator 20. The make-up pipe means 22 is inserted into the vapor separator 20 from the upper portion thereof and the inserted front end, i.e. the opened end, is controlled by a float valve 21 which is disposed in the vapor separator 20. To the make-up pipe means 22 is supplied fuel pumped up by a low pressure pump 25 from a main fuel tank located in the body of the hull. The make-up quantity of the fuel is controlled by the float valve 21 so as to be matched with the consumed fuel quantity to thereby always maintain the constant level of the fuel in the vapor separator 20.

Figure 4:
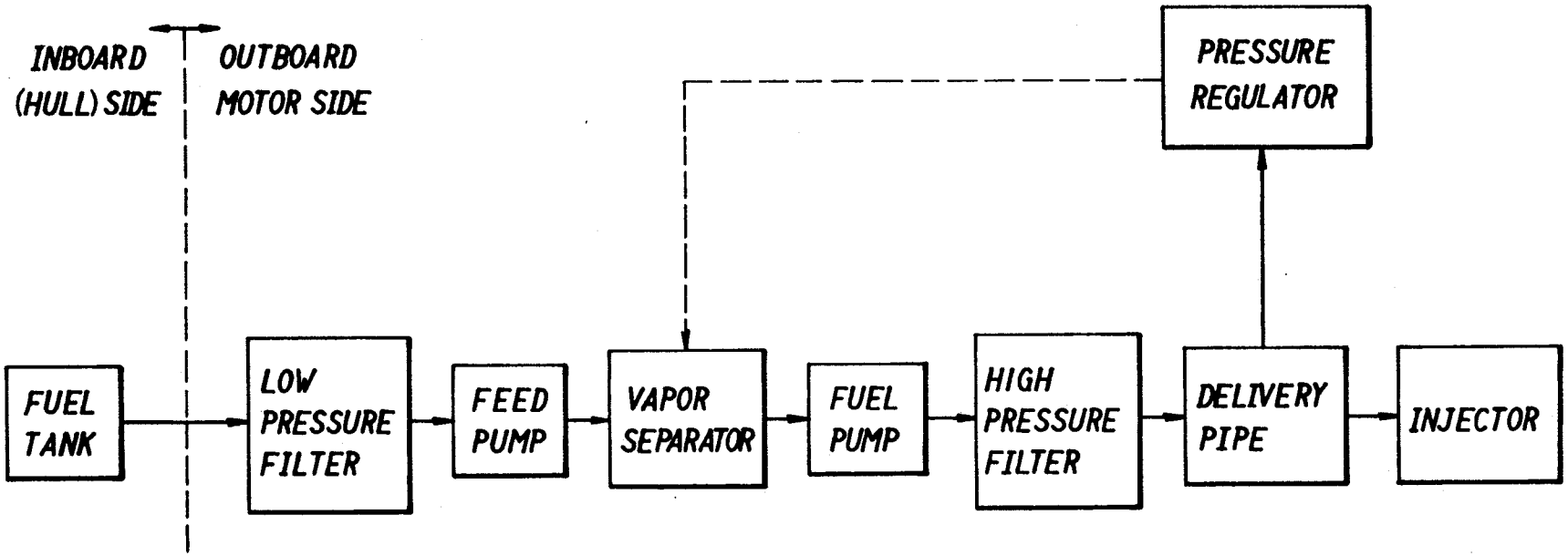
FIG. 4 is a view showing flow of the fuel in the system.

The fuel flow or circulation described above will be formulated as shown in FIG. 4.

In this embodiment, as shown in FIG. 3, the return fuel through the circulation pipe means 24 is first flown into an expansion chamber 28, integrally formed with an upper portion of the tank body or chamber of the vapor separator 20 without directly dropping into the tank body, and then into the tank body through a hole formed in a bottom of the expansion chamber 28. Accordingly, the air included in the return fuel is separated in the expansion chamber 28, whereby the fuel including substantially no air bubbles is supplied to the fuel injector 11 through the fuel supply pipe means 23 connected to the bottom of the vapor separator 20.

An air vent pipe means 29 is connected to the side of the upper portion of the vapor separator 20 and a hose 30 is connected to the air vent pipe means 29. The leading end of the connection hose 30 is connected to the throttle body 8.

The throttle valve 12 is incorporated in the throttle body 8 to which a by-pass passage 31 is opened at upstream and downstream portions of the throttle valve 12 so as to ensure the necessary air quantity even in the fully closed state of the throttle valve 12. A throttle, means 32, the throttling degree of which is adjustable, is disposed along the by-pass passage 31 to suitably set the air quantity during the idling operation.

A fuel supply or vent port 33 connected to the hose 30 is opened to the throttle body 8 at a portion near a suction side opening 31a of the by-pass passage 31. As shown in FIG. 3, the throttle passage has a varying cross section, and the port 33 is located in the region where the cross-sectional area of the throttle passage is minimum and the speed of air flowing through the throttle passage is greatest. According to the structure described above, the interior of the vapor separator 20 is communicated with the throttle body at the upstream portion of the throttle valve 12 so as to be maintained with approximately the atmospheric pressure, whereby the air-liquid separation, the fuel supply and the return fuel circulation in the interior of the vapor separator 20 can be stably performed.

In the manner thus described, the vapor filling in the vapor separator 20 is discharged into the throttle body 8 without flowing outward. The pressure in the throttle body 8 is made negative during the high rotation speed operation period of the engine and the pressure near the suction opening 31a of the by-pass passage 31 is also made negative during the idling or low rotation speed operation period of the engine. Accordingly, the discharged vapor is guided together with the air flow into the surge tank 9 and then guided through the intake manifold 10 into the crank case 5 in which the mixture is consumed without being discharged outwardly. Thus, the vapor can be surely treated, whereby the vapor separator 20 can be arranged with no fear of explosion even at a portion in which electrical equipments are arranged.

In addition, the following mutual interference which may be caused between the vapor treatment and other functions of the fuel injection system such as the engine will be substantially obviated.

The boost pressure in the air intake passage 7 is always largely changed in accordance with the opening degree of the throttle valve 12. Particularly, in a case where the throttle valve 12 is rapidly fully closed during the engine high rotation speed operation, an extremely large boost pressure is caused. When the change of the boost pressure is transferred to the fuel in the vapor separator 20, the liquid surface is waved and foamed and, in addition, the fuel itself may be sucked into the air intake passage due to the high boost pressure. In this view point, according to the described structure, the change of the boost pressure is small on the upstream side of the throttle valve 12, so that the influence of the boost pressure change is less transferred to the vapor separator 20. Moreover, since the boost pressure is a basic matter to be controlled by the EFI system, uneven boost pressure is caused and the fuel measurement error may be caused when the air vent of the vapor separator is opened therein. In this view point, according to the described structure, the air vent is opened to the upstream side of the throttle valve 12, so that the boost pressure in the air intake passage 7 is not influenced and, hence, the fuel can be precisely measured. Thus, the fuel injection function of the EFI system can be remarkably improved.

In the described embodiment, the air during the idling operation is supplied through the by-pass passage, but in a modification of this embodiment, a leak hole may be opened to the throttle valve or the throttle valve may be maintained with a small degree of opening by means of a stop screw. A composite structure of these arrangement may be also considered. Even in these modifications, since the air flow caused on the upstream side of the throttle valve during the idling or engine low rotation speed operation period is observed and the vapor port 33 is opened at the portion at which the air flow is made maximum, the described functions and effects may be also attained.

Figure 5:
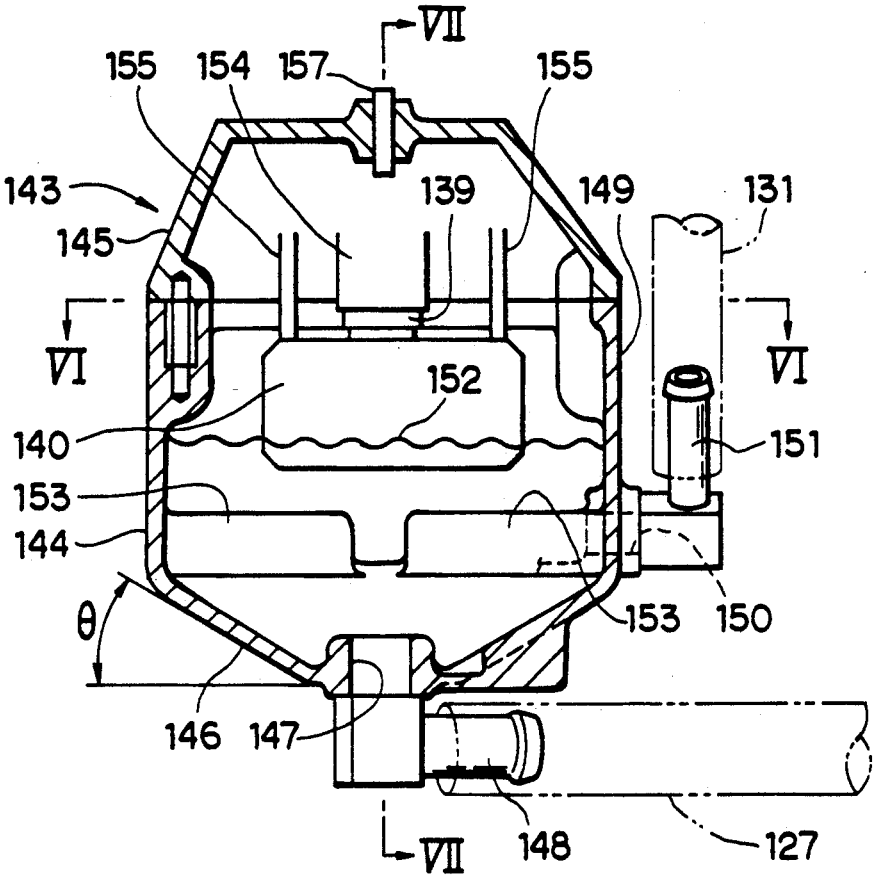
FIG. 5 is a sectional view taken along the line V—V shown in FIG. 6, later mentioned, of one embodiment of a vapor separator incorporated in a fuel injection system according to the present invention.
Figure 6:
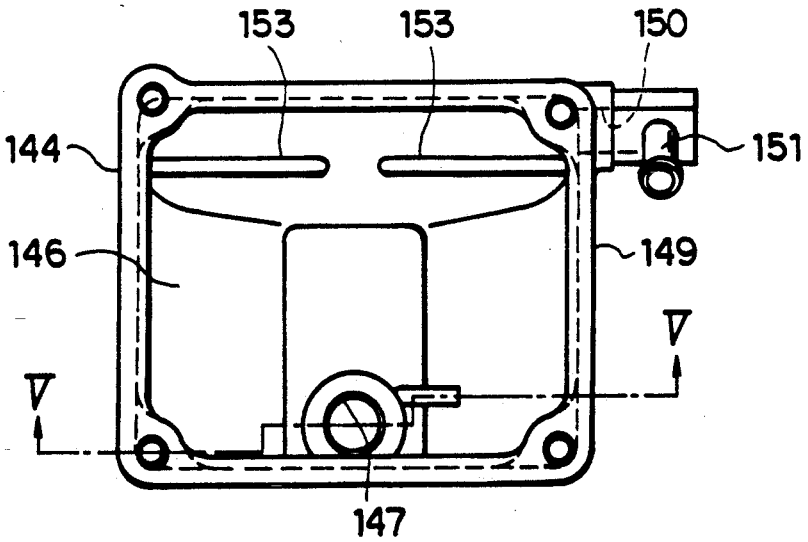
FIGS. 6 and 7 are sectional views taken along the lines VI—VI and VII—VII shown in FIG. 5.
Figure 7:
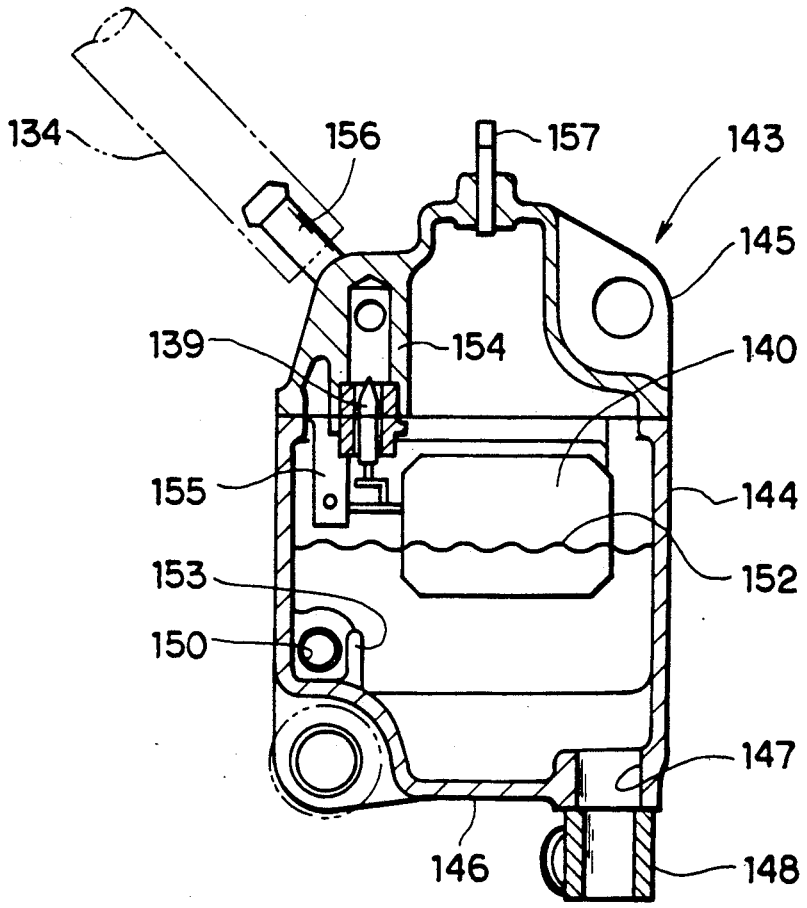

FIGS. 5, 6 and 7 show an embodiment of the vapor separator of the fuel supply and injection system according to the present invention, in which FIG. 5 is a sectional view taken along the line V—V in FIG. 6 and FIGS. 6 and 7 are sectional views taken along the lines VI—VI and VII—VII shown in FIG. 5.

Referring to FIG. 5, a vapor separator 143 is composed of a tank body or chamber 144 and a cover member 145 mated with the upper opening of the tank body 143. The bottom portion 146 is formed in a downwardly tapered or conical downward projecting shape having a projecting top to which a fuel supply pipe 127 is connected through a union 148. The downward inclination $\theta$ of the V-shaped bottom with respect to the horizontal plane is set to about 30°, for example.

A port 150 to which a return pipe 131 is connected through a union 151 is formed to the side wall 149 of the tank body 144 at a portion near the bottom 146. Accordingly, the circulation fuel passing the return pipe 131 is flown into the liquid fuel 152 stored in the vapor separator 143 below the liquid surface level. As also shown in FIG. 6, the fuel flown into the vapor separator 143 through the return fuel port 150 is guided therein by guide ribs 153.

As shown in FIGS. 5 and 7, the cover member 145 of the vapor separator 143 is equipped with a connection member 154 for the make-up fuel and a pair of float supporting members 155, both being downwardly directed. A needle valve 139 is disposed to the lower portion of the connection member 154. Accordingly, the make-up fuel from the make-up pipe 134 is controlled in quantity by the needle valve 139 and is supplied into the vapor separator 143 through the connection member 154.

The paired float supporting members 155 are arranged on both sides of the connection member 154 and a float 140 is supported to be movable by the float supporting members 155 at the lower ends thereof. The float 140 is vertically moved in accordance with the change of the surface level of the fuel 153 in the vapor separator 143 and the open-close control of the needle valve 139 can be performed in response to the vertical movement of the float 140. Reference numeral 157 designates an air vent, which may be operatively connected to the throttle body.

According to the structure of the vapor separator 143 described above, the circulation fuel from the return pipe 131 is flown into the lower portion of the fuel 152 stored in the vapor separator 143 through the connection port 150 for the return fuel, so that the return fuel is not dropped directly on the fuel stored in the tank body from the upper portion of the vapor separator as caused in the conventional vapor separator, thus preventing the formation of air bubbles in the stored fuel 152 and supplying the fuel including substantially no air bubbles to the fuel injector.

In addition, since the fuel supply pipe connection port 147 is formed at the downwardmost portion of the V-shaped bottom 146 of the vapor separator 143, the connection port 147 is not exposed to the atmosphere even if the surface of the stored fuel 152 is largely inclined by the centrifugal force which may be caused by the turning of the hull, thus suitably supplying the fuel including substantially no air to the fuel injector through the fuel supply pipe 127. In addition, the fuel injection quantity from the fuel injector can be also properly controlled and, hence, the lowering of the output of the engine can be also prevented. The burning temperature increasing of the engine due to the mixing of the air into the fuel and the seizure of the piston can be prevented.

Furthermore, since the circulation fuel is guided from the return fuel connection port 150 into the vapor separator 143 by the guide ribs 153, the flowing of the circulation fuel into the vapor separator 143 does not adverselY affect the operation of the float 140.

What is claimed is:

1. A fuel injection system of an outboard motor in which a first fuel tank is disposed on an inboard side and a second fuel tank connected to the first fuel tank is disposed on an outboard side, the second fuel tank being constituted as a vapor separator, the system including an engine including an air intake passage means comprising a throttle body in which a throttle valve is disposed and an intake manifold to which a fuel injector is mounted, said system further comprising:

fuel make-up means connected to the vapor separator for supplying a make-up fuel;

fuel return means connected to the vapor separator;

fuel supply means connected to the vapor separator for supplying fuel to the fuel injector; and vent means connected to the vapor separator, said vent means being connected to a vent port formed in the throttle body through a connection means on an upstream side of the throttle valve, the vent port opening to the interior of the throttle body at a location at which the speed of air flowing through the throttle body is highest.

2. A fuel injection system according to claim 1, wherein said fuel make-up means comprises a pipe having one end opened to an upper portion of an interior of the vapor separator, said fuel return means comprises a pipe having one end opened to an upper portion of the interior of the vapor separator, said fuel supply means comprises a pipe having one end opened to a bottom portion of the interior of the vapor separator and said vent means has a port opened to the interior of the vapor separator at a portion near the upper portion thereof.

3. A fuel injection system according to claim 2, wherein said vapor separator includes an expansion chamber formed integrally at an upper portion of the vapor separator and having a hole communicating with the interior of said vapor separator, and the opened end of the fuel return pipe is opened to said expansion chamber.

4. A fuel injection system according to claim 1, wherein an upstream side and a downstream side of the throttle valve are communicated with each other through a by-pass passage, said by-pass passage having a port on the upstream side of the throttle valve opened near the vent port formed in the throttle body.

5. A fuel injection system according to claim 4, including throttle means for throttling the flow of air through the by-pass passage.

6. A fuel injection system of an outboard motor in which a first fuel tank is disposed on an inboard side and a second fuel tank connected to the first fuel tank is disposed on an outboard side, the second fuel tank being constituted as a vapor separator, said system including:

fuel make-up means connected to the vapor separator for supplying a make-up fuel;

fuel return means connected to the vapor separator, said fuel return means comprising a fuel return pipe having one end opened to an interior of the vapor separator at a portion below a surface level of fuel stored in the vapor separator;

fuel supply means connected to the vapor separator for supplying fuel to the fuel injector;

vent means connected to the vapor separator; and wherein said vapor separator has a conical bottom, and said fuel supply means comprises a pipe having one end opened to the interior of the vapor separator at the bottommost portion of the conical bottom.

7. A fuel injection system according to claim 6, including guide means disposed in said vapor separator at a portion near the opened end of said fuel return pipe so as to guide return fuel flowing into the vapor separator thought said fuel return pipe.

8. A fuel injection system according to claim 6, wherein said vapor separator comprises a tank body having an upper opening and a cover member mated with the opening of said tank body.

9. An outboard motor comprising: an internal combustion engine; an intake manifold for mixing air and fuel and being connected to supply an air-fuel mixture to the engine; air intake means for intaking air to the intake manifold, the air intake means including a throttle valve mounted in a throttle passage through which air flows at a varying speed during use of the outboard motor; fuel injecting means for injecting fuel into the intake manifold; means including a delivery pipe for delivering fuel to the fuel injecting means; a vapor separator connected to receive makeup fuel from a fuel tank and return fuel from the delivery pipe for separating fuel vapor from the fuel, the separated fuel collecting at the bottom portion of the separator and the separated vapor collecting above the level of the fuel; fuel supply means for supplying fuel from the separator to the delivery pipe; and vent means for venting fuel vapor from the vapor separator, the vent means having one end opening into the interior of the separator above the level of fuel therein and another end opening into the throttle passage in the region thereof where the speed of air flowing through the throttle passage is the greatest.

10. An outboard motor according to claim 9, wherein the vapor separator has an expansion chamber connected to receive the return fuel for separating fuel vapor from the fuel, a tank chamber at least a part of which extends beneath the expansion chamber, and means providing communication between the expansion and tank chambers to enable fuel to flow downwardly by gravity from the expansion chamber to the tank chamber.

11. An outboard motor according to claim 10; wherein the tank chamber has a downwardly tapered bottom portion for collecting fuel, the fuel supply means being connected to the downwardmost bottom portion of the tank chamber.

12. An outboard motor according to claim 9; wherein the vapor separator has a downwardly tapered bottom portion for collecting fuel, the fuel supply means being connected to the downwardmost bottom portion of the vapor separator.

13. An outboard motor according to claim 12; wherein the vapor separator has means for introducing the return fuel into the vapor separator beneath the level of fuel collected at the bottom portion thereof.

14. An outboard motor according to claim 12; including means defining a by-pass passage communicating the upstream side of the throttle valve with the downstream side thereof.

15. An outboard motor according to claim 14; wherein the upstream end of the by-pass passage opens into the throttle passage near to where the vent means opens into the throttle passage.

16. An outboard motor according to claim 9; including means defining a by-pass passage communicating the upstream side of the throttle valve with the downstream side thereof.

17. An outboard motor according to claim 15; wherein the upstream end of the by-pass passage opens into the throttle passage near to where the vent means opens into the throttle passage.

* * * * *